US007762248B1

(12) United States Patent
Squire

(10) Patent No.: US 7,762,248 B1
(45) Date of Patent: Jul. 27, 2010

(54) MAGNETIC PAINT BALL GUN BOLT APPARATUS

(76) Inventor: Rob Squire, 11516 100$^{th}$ Place N., Maple Grove, MN (US) 55369

( * ) Notice: Subject to any disclaimer, the term of this patent is extended or adjusted under 35 U.S.C. 154(b) by 0 days.

(21) Appl. No.: 11/936,665

(22) Filed: Nov. 7, 2007

Related U.S. Application Data

(60) Provisional application No. 60/864,787, filed on Nov. 7, 2006, provisional application No. 60/916,850, filed on May 9, 2007.

(51) Int. Cl.
*F41B 11/00* (2006.01)

(52) U.S. Cl. ..... 124/80

(58) Field of Classification Search ..... 124/41–44.7, 124/53, 80, 52, 1, 3; 403/315–320; 411/351; 42/99; 335/285
See application file for complete search history.

(56) References Cited

U.S. PATENT DOCUMENTS 3,264,678 A * 8/1966 Parmelee ..... 16/228
3,401,587 A * 9/1968 Kalls ..... 411/351
3,429,586 A * 2/1969 Force ..... 280/515
3,610,222 A 10/1971 Hartman
3,770,290 A 11/1973 Bottalico
4,314,623 A 2/1982 Kurokawa
4,432,441 A 2/1984 Kurokawa
4,468,883 A 9/1984 Williams
4,483,550 A * 11/1984 Dubbe ..... 280/515
4,819,609 A 4/1989 Tippmann
4,936,282 A * 6/1990 Dobbins et al. ..... 124/74
5,017,819 A 5/1991 Patt et al.
5,074,189 A 12/1991 Kurtz
5,120,030 A 6/1992 Lin et al.
5,161,516 A 11/1992 Ekstrom
5,204,572 A * 4/1993 Ferreira ..... 310/156.19

(Continued)

OTHER PUBLICATIONS

"E-mag Exploded View", emagexploded.pdf, from http://www.airgun.com/downloads/emagexploded.pdf, Apr. 16, 2004, 49 pages, AirgunDesigns, Inc.

(Continued)

*Primary Examiner*—Troy Chambers
*Assistant Examiner*—Reginald Tillman, Jr.
(74) *Attorney, Agent, or Firm*—Albert W. Watkins

(57) ABSTRACT

A magnetic paint ball gun firing apparatus provides magnetic coupling between rigid components that are used to position paint balls within a paint ball gun. When force is applied to one of the pair of magnets, the force will be transmitted through the magnetic fields to the second magnet. In several of the embodiments, this magnetic coupling offers low resistance to movement when the magnets are in an initial substantially spaced apart relationship. Such low force coupling ensures gentle handling of the paint balls. However, as the limits of travel are approached, the magnetic coupling will exponentially increase forces between the magnets, preventing a "bottoming out" of the coupling. In other disclosed embodiments, magnets are arranged in a pulling arrangement, with opposite poles attracting each other. In these instances, break-away forces are high, but once separated, forces drop exponentially. Illustrated embodiments include magnetic bolt pin couplings, magnetic break-away bolts, and magnetic bolt tips. In addition to magnetic coupling, a bolt is provided that has a front core for improved airflow dynamics. The core may optionally be interchangeable with alternative cores having different geometries and resultant different flow patterns.

9 Claims, 4 Drawing Sheets

U.S. PATENT DOCUMENTS

| | | | | |
|---|---|---|---|---|
| 5,257,614 | A | 11/1993 | Sullivan | |
| 5,280,778 | A | 1/1994 | Kotsiopoulos | |
| 5,327,878 | A | 7/1994 | Wittbrot | |
| 5,339,791 | A | 8/1994 | Sullivan | |
| 5,460,094 | A | 10/1995 | Ono | |
| 5,462,042 | A | 10/1995 | Greenwell | |
| 5,494,024 | A | 2/1996 | Scott | |
| 5,515,838 | A | 5/1996 | Anderson | |
| 5,564,747 | A | 10/1996 | Ono et al. | |
| 5,630,406 | A | 5/1997 | Dumont | |
| 5,642,089 | A * | 6/1997 | Lysen | 335/285 |
| 5,655,510 | A | 8/1997 | Kunimoto | |
| 5,727,538 | A | 3/1998 | Ellis | |
| 5,823,173 | A | 10/1998 | Slonaker et al. | |
| 6,273,080 | B1 | 8/2001 | Sullivan, Jr. | |
| 6,324,779 | B1 | 12/2001 | Tippmann, Jr. | |
| 6,439,217 | B1 * | 8/2002 | Shih | 124/77 |
| 6,474,326 | B1 | 11/2002 | Smith et al. | |
| 6,494,195 | B2 | 12/2002 | Perry et al. | |
| 6,516,791 | B2 | 2/2003 | Perrone | |
| 6,520,172 | B2 | 2/2003 | Perrone | |
| 6,526,685 | B2 | 3/2003 | Tippmann, Jr. | |
| 6,561,176 | B1 | 5/2003 | Fujimoto et al. | |
| 6,568,381 | B2 | 5/2003 | Chang | |
| 6,655,372 | B1 | 12/2003 | Field et al. | |
| 6,668,478 | B2 | 12/2003 | Bergstrom | |
| 2001/0003802 | A1 | 6/2001 | Vitale | |
| 2002/0040543 | A1 | 4/2002 | Tippmann, Jr. | |
| 2004/0062596 | A1 * | 4/2004 | Walworth et al. | 403/373 |
| 2005/0115552 | A1 * | 6/2005 | Dobbins | 124/73 |
| 2007/0017498 | A1 | 1/2007 | Finstad | |
| 2007/0277798 | A1 * | 12/2007 | Bhogal | 124/74 |

OTHER PUBLICATIONS

"Toxic Magnetic Trigger Frame for Matrix", from http://www.warpig.com/paintball/technical/misc/toxicmagframe/index.html, Apr. 13, 2004, 3 pages Warpig.

Small Parts Shocker Base, http://paintballerz.com/Scripts/prodVies.asp?idProduct=466, 2003, 2 pages, Paintballerz.com.

"Owners Manual for Ranger Series", http://www.armyoforr.com/images/Downloads/RangerManual.pdf, May 18, 2004, 19 pages, Worr Game Products.

"Lapko Paintball Products Wholesale", http://www.lapcopaintball.com/autococker.html, May 18, 2004, 2 pages, LAPCO Paintball Products.

"Eclipseblade" Operatrng Manual, http://www.armyoforr.com/images/Downloads/eBladeBook.pdf, Apr. 16, 2004, 79 pages, Planet Eclipse Ltd.

The Phantom Online,http://www.phantomonline.com/, May 18, 2004, 2 pages, Component Concepts, Inc.

"New Reverse Polarity Magnetic Trigger Kit for the Intimidator", http://www2.criticalpaintball.com/product_info.php/products_id/67?osCsid=af2c267956dc9f38daad5b520260978b, Apr. 13, 2004, 2 pages, Critical Paintball.com.

"E-Class Orracle Autococker by WGP", http://www.madcocker.com/detail.asp?AwID=121&CategoryID=, Apr. 14, 2004, 2 pages, Critical Paintball.com. Dark Side Games, Corp.

* cited by examiner

MAGNETIC PAINT BALL GUN BOLT APPARATUS

CROSS REFERENCE TO RELATED APPLICATIONS

This application claims priority to U.S. provisional patent application Ser. No. 60/864,787 filed Nov. 7, 2006 and entitled "Bolt with Interchangeable Front Core for Improved Airflow Dynamics," and also to U.S. provisional patent application Ser. No. 60/916,850 filed May 9, 2007 and entitled "Bolt with Interchangeable Front Core for Improved Airflow Dynamics," each naming the present inventor, the contents of each which are incorporated herein by reference in entirety.

BACKGROUND OF THE INVENTION

1. Field of the Invention

This invention pertains generally to mechanical guns and projectors, and more specifically to magnetic couplings which offer improved interaction with and operation of paint ball gun bolts.

2. Description of the Related Art

Paint ball guns have enjoyed much popularity for a number of years. The sport offers the challenge and intrigue of competitions and battles that stimulate a person's consciousness. However, unlike actual wars, hunts and the like, the combatants may return day after day to continue to test and refine their skills.

In a paint ball competition, the paint balls themselves are designed to be propelled by a gun which uses pressurized gas as the propellant. The paint ball is designed to withstand normal movements inside of the gun, while being sufficiently frangible to break upon impact, subsequent to being propelled. When the paint ball strikes a competitor, it will break and mark the person who has been hit. Consequently, the ball must also be sufficiently soft to not cause harm to the person, though it is understood that in most competitions the person will be wearing basic protective gear such as goggles and the like to protect body parts which would otherwise be too easily harmed.

Modern paint balls are typically comprised of gelatinous compounds which offer both the necessary toughness to survive gun use and the rupture strengths that are low enough to lead to breakage on impact. Unfortunately, it is also known that many factors can affect the characteristics of the paint ball outer membrane, including but not limited to such diverse factors as temperature, humidity, manufacturing tolerances, production or post-production handling, and the like.

Since the paint ball must be sufficiently soft and frangible to not harm the competitors, and to reliably break upon impact, and since there are unpredictable factors that may weaken the ball, a paint ball gun must be designed to handle the paint balls as gently as possible. Otherwise, paint balls may break inside the gun, even prior to firing. When a paint ball does break, the gun may be disabled until the competitor cleans out both the paint and the gelatin capsule. When this occurs deep inside the gun, the time required for cleaning may be too great, leaving the competitor defenseless against another competitor. Consequently, it is highly desirable to have the most reliable handling of paint balls within the gun possible, and simultaneously to facilitate rapid bolt removal and cleaning.

A typical paint ball gun must receive a single paint ball and position the ball into the breech. Subsequently, the gun will expel the ball using a blast of pressurized gas. The source of paint balls is typically a magazine, which will hold a plurality of paint balls therein. The magazine in turn couples to the gun just ahead of a bolt, and typically at an angle offset from parallel to the gun barrel. To ensure a single paint ball is placed into the breech, a bolt travels parallel to the gun barrel, and in a first position permits a single paint ball to pass down into the path parallel to the barrel. Next, the bolt will travel forward, both moving the paint ball forward into the breech and simultaneously blocking the passage of any additional paint balls from the magazine into the barrel region. The bolt additionally blocks back-flow of propellant into the magazine feed path. This handling of the paint ball by the bolt is one of several critical controlled movements that are made by a paint ball gun, often in very small fractions of a second.

Once the paintball has dropped into the breech, any further movement of the paintball within the breech is detrimental to the performance of a paintball gun, particularly when provided with force-feed loaders. Most desirably, the ball will remain centered below the feedneck while in the breech. When the ball is so located, the next ball in the feedstack will be elevated as much as possible, by virtue of resting on the highest point of the first ball. By so elevating the second ball in the stack, the top leading edge of the gun bolt is less likely to clip this second ball. If, instead, the paintball is permitted to move off-center, the next ball will not rest on the very top of the first, but may instead rest somewhere lower. In such instance, the second ball may be within the diameter traversed by the bolt, and so would be more prone to being chopped during firing. When a paintball is inadvertently mis-positioned, and so interferes with the travel of the bolt, there is no provision within the linkage for halting the travel of the bolt. In other words, when a ball is in the wrong place at the wrong time, chopping is imminent.

Paintballs are inconsistent from batch to batch and brand to brand. Consequently, it is not possible to selection a position for the bolt to rest and accommodate all paintballs. As a result, prior art bolts are prone to chopping paintballs of size which deviates from the size for which the gun was designed.

In addition to the proper handling of paint balls, it is also highly desirable to facilitate rapid bolt removal and breech and barrel cleaning. No matter how well a gun is designed, there will remain occasions where through some combination of timing, weather, defects and dimensional variances within a ball, and numerous other variables, a ball will break within or adjacent to the breech region. In such a case, a competitor will desirably clean the gun as quickly as possible, and without the need to resort to the use of any tools to disassemble the gun. Heretofore, this has been achieved by providing the bolt with a bolt pin which couples with an underlying ram. The bolt pin extends perpendicular to the direction of travel of the bolt and ram, and is commonly spring loaded to drive the bolt pin into engagement with the ram.

These teachings of the prior art are incorporated herein by reference, together with Webster's New Universal Unabridged Dictionary, Second Edition copyright 1983, which is incorporated herein by reference in entirety for the definitions of words and terms used herein.

SUMMARY OF THE INVENTION

In a first manifestation, the invention is a paint ball gun bolt, a bolt pin, and a magnetic coupling having a first stable position holding the bolt pin stable relative to the paint ball gun bolt and having first and second unstable regions oppositely displaced from the first stable position wherein which the bolt pin will move relative to gun bolt absent application of an external balancing force.

In a second manifestation, the invention is, in combination, a paint ball gun barrel, a paint ball, and a means for controlling a position of the paint ball within paint ball gun barrel. The improvement comprises a floating paint ball face suitable for contacting and moving the paint ball, a means for limiting a position of the paint ball face, and a magnetic coupling between the limiting means and the floating paint ball face.

In a third manifestation, the invention is a bolt having a generally cylindrical core extensive along a longitudinal axis, and defining a gas flow bath that deviates from cylindrical along said longitudinal axis.

In a fourth manifestation, the invention comprises a bolt pin engaged with a bolt, a ram, and a magnetic linkage between the bolt pin and ram.

OBJECTS OF THE INVENTION

Exemplary embodiments of the present invention solve inadequacies of the prior art by providing magnetic coupling between certain ones of paintball gun bolt components. Contemplated are magnetic bolt pin couplings, magnetic breakaway bolts, and magnetic bolt tips. In addition to magnetic coupling, a bolt is provided that has a front core for improved airflow dynamics. The core may optionally be interchangeable with alternative cores having different geometries.

A first object of the invention is to improve the handling of paint balls within a paint ball gun, to reduce the likelihood of the paint ball breaking during such handling. A second object of the invention is to enhance the reliability of operation of the paint ball gun. Another object of the present invention is to achieve the foregoing objectives using components and apparatus which directly substitute for or replace less effective or reliable prior art components. A further object of the invention is to reduce the complexity of the paint ball gun, while achieving the foregoing objectives. Yet another object of the invention is to incorporate an improved force-travel function for operation of a paint ball gun bolt which is less prone to breaking a paint ball. An additional object of the invention is to improve gun recoil, and thereby improve both accuracy and comfort. Another object of the present invention is to enable custom control over paint ball spin, and therefore trajectory.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Figure 1:
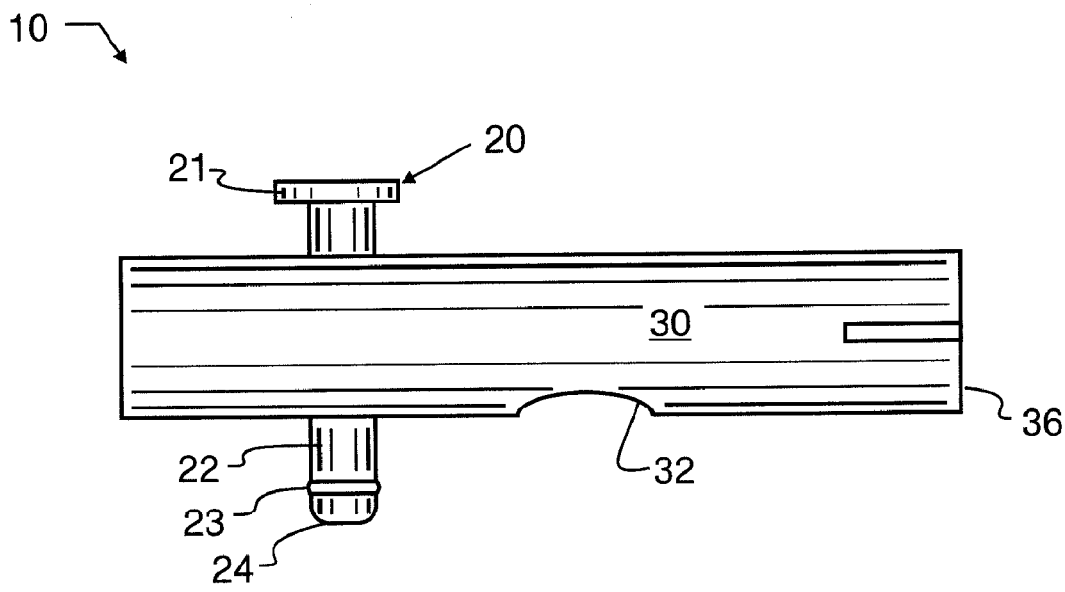
FIG. 1 illustrates a first preferred embodiment paint ball gun bolt and bolt pin designed in accord with the teachings of the invention from side plan view.

In a most preferred embodiment firing apparatus 10 of the invention illustrated in FIGS. 1-5, bolt 30 and bolt pin 20 are coupled together to move as a unitary structure within any of a wide variety of prior art paint ball guns that use both a ram and bolt. Bolt pin 20 has a head 21 which is preferably readily grasped manually. In the preferred embodiment, a flattened head similar in geometry to a roofing nail head or the like is illustrated, though head 21 may be of any suitable geometry. A generally cylindrical ram body 22 extends from head 21 through bolt 30, terminating at ram coupler 24. Ram coupler 24 is illustrated having the geometry resembling an arrow nock, which is common and well known in the paint ball industry. Adjacent to ram coupler 24 is a small o-ring 23. Bolt 30 includes a high pressure gas inlet 32 which receives high pressure gas during the firing of a paint ball, and discharges the high pressure gas at outlet 36. Just prior to discharge of a paint ball, outlet 36 will be immediately adjacent to the paint ball.

Figure 2:
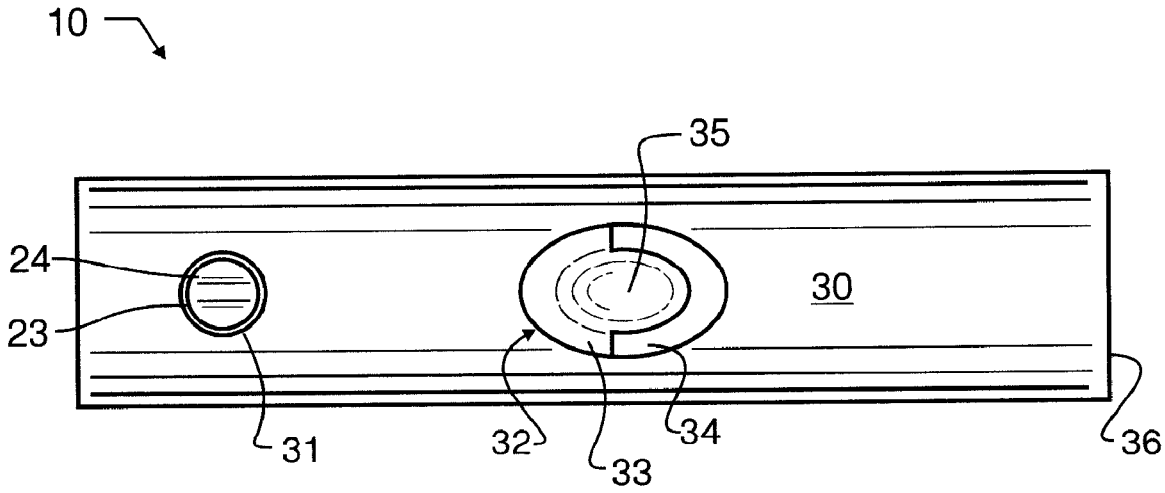
FIG. 2 illustrates the first preferred embodiment paint ball gun bolt and bolt pin of FIG. 1 from bottom plan view.

FIG. 2 illustrates the placement of bolt pin 20 within bolt 30. Desirably, a bore 31 is provided which relatively snugly receives bolt pin 20, but which permits bolt pin 20 to move with minimal or no encumbrance. Also visible in FIG. 2 is the geometry of high pressure gas inlet 32, which takes a concave shape resembling that of an ice cream scoop. The side walls of scoop 33 curve down into a central region of greatest depression 35, and high pressure gas will pass adjacent central region 35 and then through passage 34. While scoop 33 is illustrated as having a gradual curve, it will be understood that different geometries will produce different gas flow patterns and behaviors, the choice of which is considered to be incorporated herein. In the preferred embodiment, side walls 33 and central region of greatest depression 35 may be formed by directly machining bolt 30.

Because of the placement of scoop 33, the high pressure air stream passing into bolt 30 will be redirected in similar fashion as water striking an ice cream scoop placed under a water faucet. When properly positioned, directly in line with the opening in outer shell 38, a high pressure gas stream is launched in the direction of the scoop flow. This scoop 33 results in several benefits and advantages not found in the prior art, including improved air flow through and out of bolt 30, and reduced back pressure, also referred to as kick or recoil, of a marker in which bolt 30 is installed. Reduced kick increases user accuracy while decreasing user fatigue and tension.

While not being bound to any theory or hypothesis, and knowing that the present scoop 33 operates for benefit as described herein above regardless of the accuracy of the present theory, it is proposed herein that the reason for the reduced kick is due to the fluid dynamics of the high pressure gas as it enters into the bolt, and how those dynamics change with respect to time during the firing cycle. When the gun valve is initially opened, the bolt interior is at a substantially lower pressure than the incoming gas. Consequently, there is an initial large surge or flow of gas into bolt 30, which is redirected by scoop 33. This large flow, when redirected, will create a great deal of turbulence as it passes through scoop 33, and is redirected into the adjacent air streams, thereby preventing laminar flow even in the adjacent air streams. As a result, during the initial introduction of high pressure gas, it is hypothesized that the preferred scoop 33 will create a flow restriction due to this induction of turbulence, thereby increasing the amount of time required for gas to pass into passage 34 to build pressure within the bolt 30. Since pressure builds more slowly than in the prior art, the initial impulse which would go from zero to full pressure nearly instantaneously in the prior art is avoided. This impulse pressure function of the prior art will very rapidly accelerate the paintball, but it will also, in accord with Newton's laws, generate a very large, short duration equal and opposite force on the gun, resulting in large and sudden kick or recoil.

In accord with the present hypothesis, if the flow restriction were to remain, the paintball velocity leaving the gun would be lower than in the prior art. This preferred embodiment bolt 30, which includes scoop 33, does not suffer this drawback. Again, while not being bound by any theory, it is proposed herein that, as pressure builds within bolt 30, there will be a reduced flow of gas into bolt 30. Whether this is the case, or if due to other reasons, it is proposed herein that after the initial inrush which occurs due to the low or atmospheric pressure initially present within the bolt, the flow past the scoop changes from the initial turbulent flow to a more laminar and less obstructive flow. When this change occurs, scoop 33 provides an improved flow path. As long as there is sufficient cross-sectional area which is not interfered with by turbulence, bolt 30 will provide less flow restriction than the gun high pressure valve, and so the gun valve will be the primary factor limiting flow rate just as in the prior art. When this change from turbulent flow to laminar flow occurs, the maximum ball velocity will only be limited by how fast the gas may enter behind the already moving paintball, at what pressure, and how long the barrel is. Said another way, the lack of the initial impulse or kick in the second preferred embodiment may accelerate the paintball at a rate slower than in the prior art, but as long as there is sufficient barrel length, as found in nearly all commercial markers, the second preferred embodiment will continue to accelerate the paintball within the barrel, ultimately achieving the same limiting velocity that the prior art achieves. The end result is a lower initial impulse, but higher ongoing forces until the paintball has achieved the same terminal velocity as in the prior art. This, in turn, represents a much easier force for an end user to control, which, again, regardless of the accuracy of the present theory, is what the preferred scoop achieves. In the event the present theory is accurate, those skilled in the art will recognize from the above description the critical features that must be considered to design a low-recoil bolt, whether using the scoop or some other fluid flow equivalent that could be readily and obviously predicted based upon the foregoing.

Figure 3:
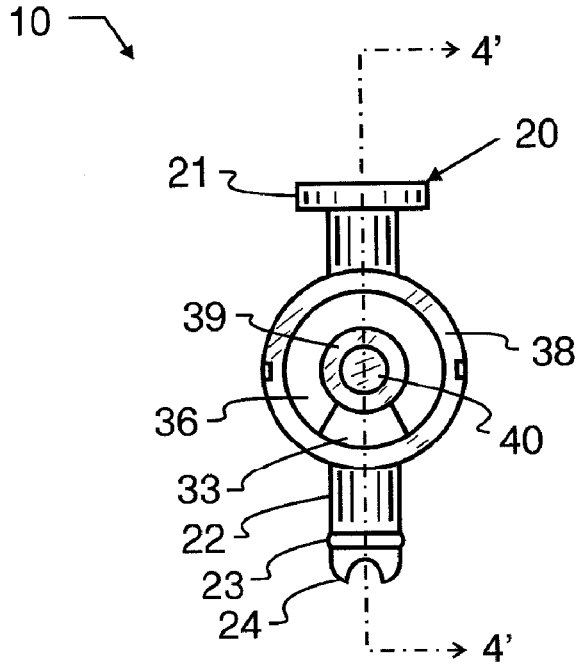
FIG. 3 illustrates the first preferred embodiment paint ball gun bolt and bolt pin of FIG. 1 from front plan view.
Figure 4:
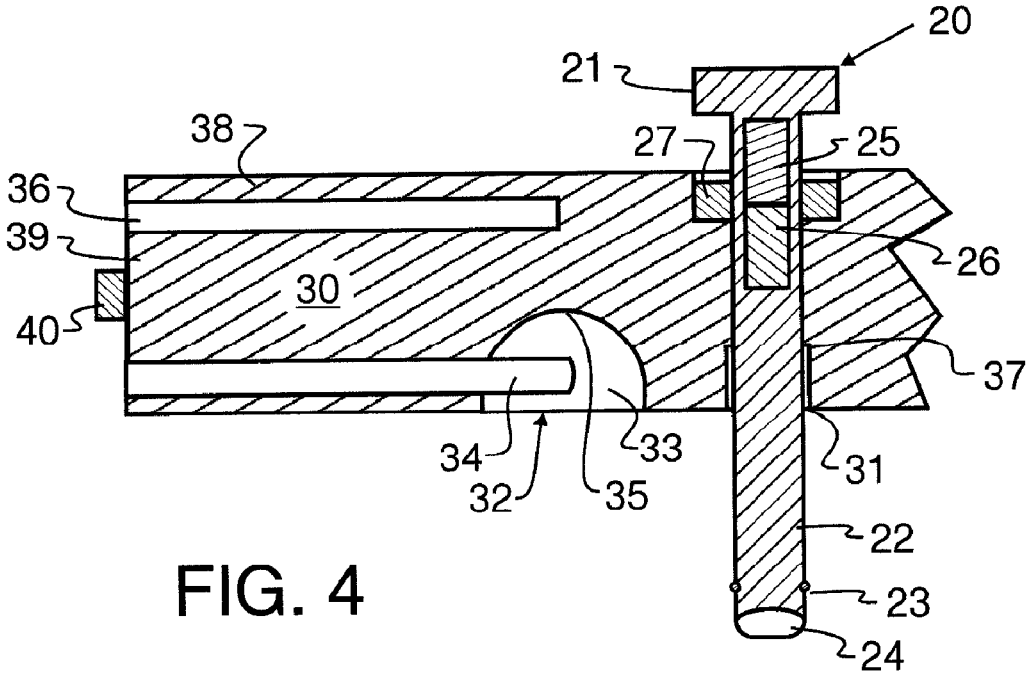
FIG. 4 illustrates the first preferred embodiment paint ball gun bolt and bolt pin of FIG. 1 from cross-sectional view taken along line 4' of FIG. 3.

In accord with this preferred embodiment, a second important feature may be found illustrated in FIGS. 3 and 4. As may be seen therein, bolt inner core 39 has a magnet 40 mounted adjacent to the tip of the core 39. One or more magnets 40 may be so mounted. This allows the user to add an appropriate number or thickness of magnets to adjust to a desired paintball diameter, in turn properly positioning a paintball resting in the breech. By adding one or more magnets 40, or by varying magnet 40 thickness adjacent to the core tip as taught by the present invention, the user can adjust where the center point is for the paint ball stack. When a paint ball within the breech properly aligns with the paint ball stack coming from a magazine, the gun operation is optimal, with reduced ball chopping during firing. So, with a very easy gun modification requiring only a few seconds to implement, a user may adapt a gun incorporating the present invention to the diameter of particular paintballs being used at that moment.

The use of a core 39 not only provides the interactions with gas flow as described herein above, but also permits a firing apparatus such as firing apparatus 10 to be further modified. Contemplated herein is a custom or changeable core 39 or outer shell 38. A bolt 30 designed in accord with the present invention will most preferably direct airflow to specific areas of the paintball in the paintball gun breech to equalize airflow and improve consistency of shot. This can be achieved by using different machined and designed patterns on either of the internal center core 39 and outer shell 38, as well as different spatial relationships between the inner core 39 and outer shell 38. The ability for interchangeability and control is a very powerful tool for the end user, as each can set up his or her system for the optimum conditions or playing style.

There are a variety of methods to attach inner core 39 within bolt 30. One suitable approach is to use a nut to secure a male threaded inner core 39 into place. Another approach is to have an inner core 39 and outer shell 38 which are both held in place using the bolt-to-ram locking pin 20. Other suitable approaches will be apparent, including such techniques as machining the core from the shell, welding or adhesively fastening the two together, or affixing them in place with set screws or pins.

The present invention thereby contemplates the directing of airflow exiting the bolt by using various shapes and sizes of inner cores and outer shells, in turn directly impacting the performance and flight of the paintball. Exemplary of the possible various arrangements is a first bolt which directs air to the outer boundary of the paintball for an evenly distributed air pattern around the outer back edges of the paintball, in turn providing a consistent cushion of air around the outside of the paintball. Another bolt different from the first will instead direct all the air in a downward fashion towards the back of the paintball, thereby inducing a backspin on the ball. Bolts may also be used to induce airflow on the sides or even the top of the ball to increase spin on any given side of the paintball, which has an impact on distance or direction the ball can travel. This is very advantageous to the paintball player who is trying to shoot under tree branches without arching his marker or trying to shoot around an object using controlled spin similar to a baseball pitcher's curveball.

Figure 5:
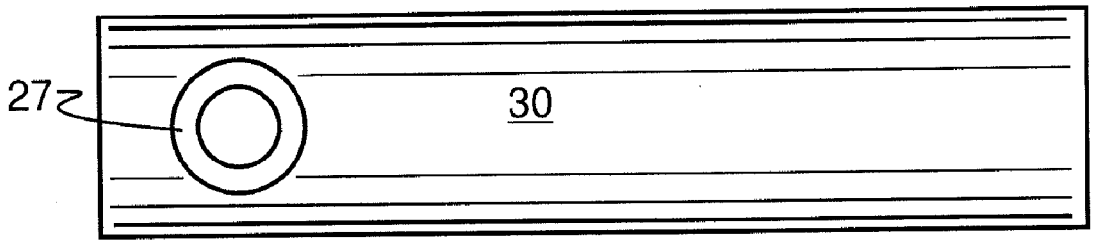
FIG. 5 illustrates the first preferred embodiment paint ball gun bolt of FIG. 1 from top plan view, with the bolt pin removed.

Another important feature of the present invention is a magnetic locking mechanism for bolt pin 20. Most prior art bolts use a spring and plunger to lock a bolt pin down into the ram of the paintball marker. Illustrated in preferred embodiment firing apparatus 10 and best visible in FIGS. 4 and 5 is ring magnet 27, through which bolt pin 20 passes. Within bolt pin 20 are two cylindrical magnets 25, 26, which are polarized oppositely to each other along an axis parallel to the longitudinal axis of ram body 22. These magnets will preferably not be touching each other, but may be physically close together. Ring magnet 27 may be polarized either along an axis parallel to the longitudinal axis of ram body 22, or instead radially, but will have polarity adjacent to the junction of magnets 25, 26 which is opposite to the polarity of each of those magnets 25, 26 at their most adjacent faces. This combination of magnets 25-27 results in a position of stability, where without extraneous forces being applied, bolt pin 20 will align with bolt 30 in a position similar to that illustrated in FIG. 4, with ring magnet 27 pulled to the faces of magnets 25, 26 most adjacent to each other. This arrangement of magnets as illustrated produces two regions of instability when bolt pin 20 is offset therefrom. As an example, if ring magnet 27 is magnetized parallel to the longitudinal axis of ram body 22, and has a North pole more adjacent to ram head 21 than South pole, and magnets 25, 26 have most adjacent surfaces each polarized to South, then ram 20 will at rest locate the junction between magnets 25, 26 adjacent to the North pole of ring magnet 27. Movement of bolt pin 20 such that head 21 gets closer to ring magnet 27 will bring the North pole of ring magnet 27 more nearly adjacent to the North pole of magnet 25, which will repel head 21 from ring magnet 27. This is the first region of instability, since without an externally applied force, head 21 will simply pop back up away from ring magnet 27. Movement of bolt pin 20 such that head 21 gets farther from ring magnet 27 will bring the North pole of ring magnet 27 more nearly adjacent to the North pole of magnet 26, which will at first repel head 21 from ring magnet 27. Without an externally applied force, head 21 will again simply pop back towards ring magnet 27. However, if bolt pin 20 is pulled such that the North pole of ring magnet 27 passes beyond the North pole of magnet 25, head 21 will continue to be driven away from ring magnet 27. This is the second region of instability, since without an externally applied force, head 21 will continue to move away from ring magnet 27. To limit the ultimate travel of pin 20, and thereby hold pin 20 into bolt 30 regardless of the magnetic forces, a small o-ring 23 is provided which passes into opening 31, but which interferes with the smaller diameter at shoulder 37, thereby resisting removal. The presence of o-ring 23 and shoulder 37 creates a second region of stability, where opposing magnetic forces created between magnet 26 and ring magnet 27 are balanced by forces between o-ring 23 and shoulder 37.

While the preferred embodiment illustrates the combination of ring magnet 27 and cylindrical magnets 25, 26, those skilled in the art of magnets will recognize alternative arrangements which will perform the desired function. The present invention is not limited to magnets inside bolt pin 20 and can also be effective when used with a steel bolt pin, a magnet mounted horizontally through pin 20, and/or ring magnets mounted on bolt pin 20. The present invention holds advantages to reduced number of parts in the assembly, easy quick release of bolt 30 from a marker, and overall length of bolt pin 20 to be shortened enough to have a significant difference in weight, which can affect the cycle speed of a marker.

Magnets are also contemplated herein as a replacement for typical locking mechanism that holds the bolt pieces in place. If a paintball does not fully load in the chamber of the breech and the paintball marker is fired, the paintball in a prior art gun will typically become wedged, broken or crushed, resulting in a mess inside the gun bore that will interfere with proper gun operation. The concept of using magnets as a locking mechanism is to continue normal operation of the marker and gun bolt system during operation. However if the non-optimum situation is to occur and the paintball gun is to fire before the paintball has been fully loaded into the gun breech, the magnetic locking system will detach and the front half of the bolt system will stay in place, allowing the rest of the marker to cycle as normally without bringing the rest of the bolt through the cycle as it is stopped on the paintball or behind the paintball. During the standard return cycle of the bolt and ram, the disengaged portion of the bolt will come in contact with the magnetic pieces again and reseat itself to normal operating conditions.

There are numerous styles and methods of achieving this including having high strength magnets on the front half of the bolt and high strength magnetic on the back half of bolt. Magnets can be used in a pull/pull orientation or even as a push/push orientation depending on the setup. Magnets can also be located in the bolt pin, such as bolt pin 20, that connects the bolt to the lower ram system. In such instance, at least one or both of ram coupler 24 or the ram would be magnetic, and the other would either be magnetic or magnetically susceptible.

Figure 6:
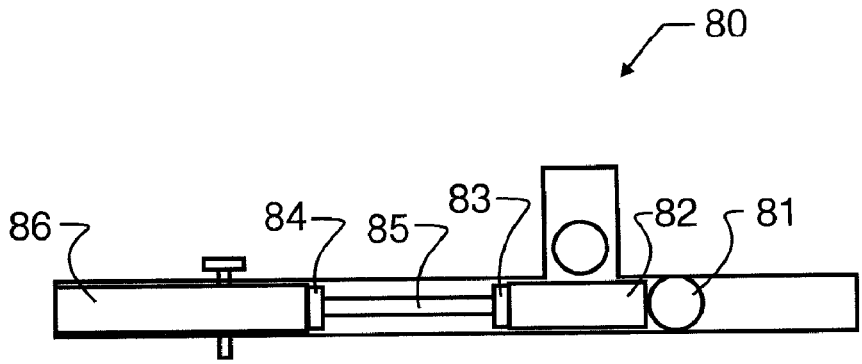
FIGS. 6 and 7 illustrate a preferred embodiment bolt designed in accord with the teachings of the present invention in two alternative positions from schematic side plan view.
Figure 7:
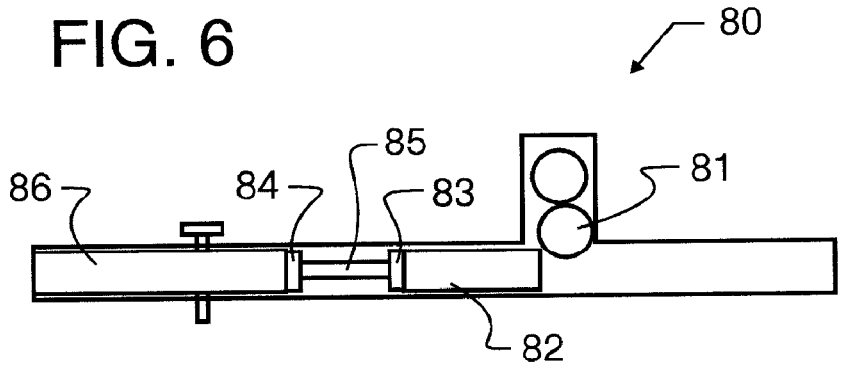

FIGS. 6 and 7 illustrate a preferred embodiment firing apparatus 80 designed in accord with the teachings of the present invention in two alternative positions from schematic side plan view. With like poles facing each other, the forces are minimal until magnets 83, 84 are adjacent each other, allowing a lower initial force to be placed upon ball 81 at the time of first contact, thereby preventing ball breakage better than in the prior art. Said another way, the initial impact of bolt face 82 onto ball 81 will preferably be gentler than with a standard spring. As shown in FIG. 7, if paint ball 81 has not dropped fully into the gun barrel when bolt 86 is activated, bolt face 82 may slide upon rod 85 and bring the two magnets 83, 84 closer together, again with less chance of damaging ball 81 than in the prior art. In this case, the air burst into the breech will be discharged without firing a ball, and the pinched ball 81 of FIG. 7 will then enter the breech to be fired on the next cycle, after bolt body 86 cycles backwards and pulls bolt face 82 therewith.

Figure 8:
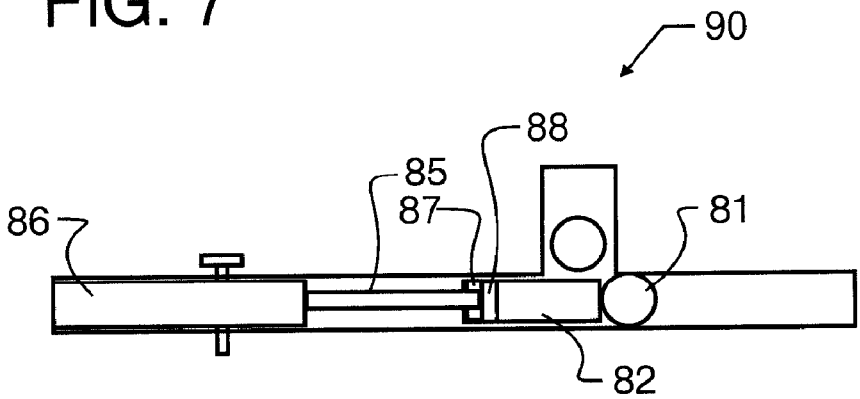
FIGS. 8 and 9 illustrate an alternative embodiment bolt designed in accord with the teachings of the present invention in two alternative positions from schematic side plan view.
Figure 9:
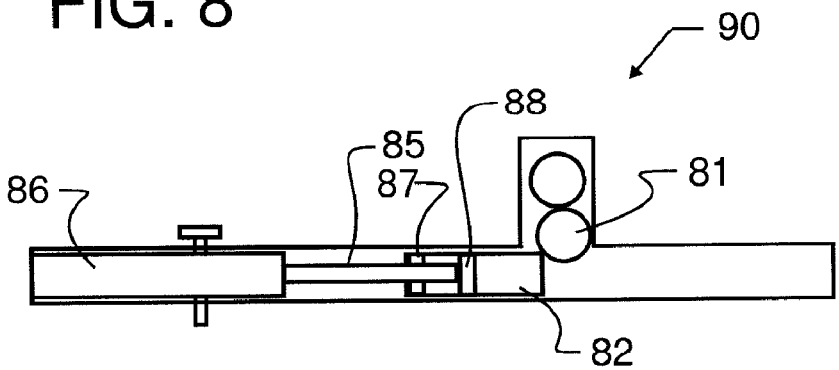

As but one example of the possible variations in magnetic couplings afforded by the present invention, FIGS. 8 and 9 illustrate a second embodiment break-away bolt. In this case, a ring magnet 87 encircles rod 85, and a second cylindrical magnet 88 terminates rod 85. As best illustrated in FIG. 9, when a paint ball 81 jams, the force of attraction between magnets 87 and 88 is overcome, and rod 85 then slides within bolt face 82.

Figure 10:
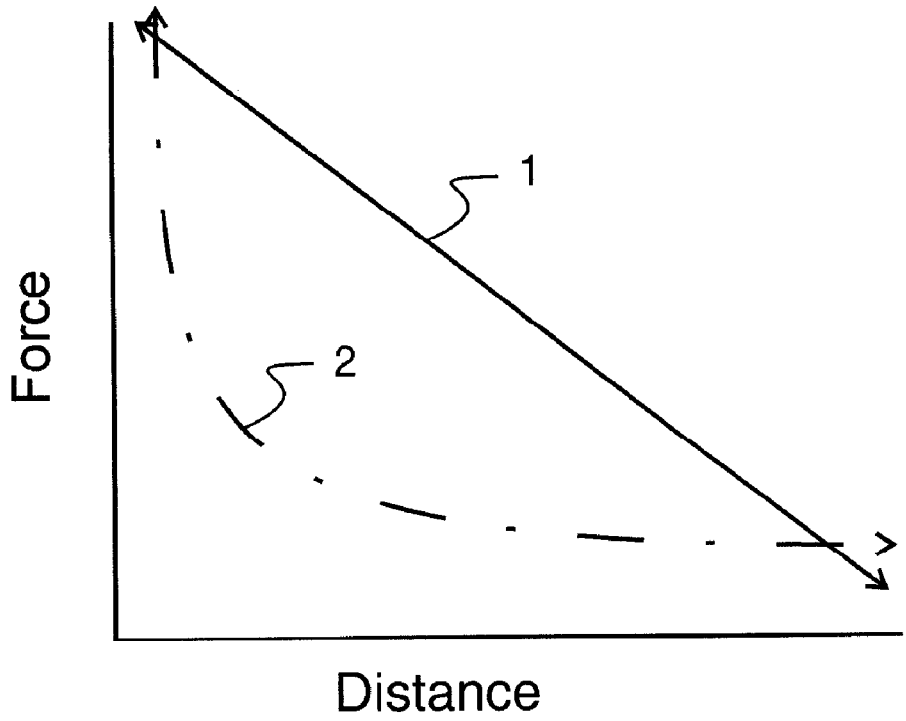
FIG. 10 illustrates the force with respect to distance curves for prior art springs and for magnetic coupling of the present invention.

Several of the features found in the foregoing embodiments illustrate several different and independent situations which use the non-linear force function of magnetic coupling for synergistic benefit within a paint ball gun. These applications each benefit from the non-linear magnetic force curve 2 illustrated in FIG. 10. A spring has a generally linear force versus travel curve 1, which in many applications is disadvantageous when compared with the non-linear magnetic force curve 2.

From the present specification and figures discussed herein above, several additional features and options become more apparent. First of all, the preferred and alternative embodiments may be manufactured from a variety of materials, including metals, resins and plastics, ceramics or cementitious materials, special alloys, or even combinations of the above. The most preferred materials for the embodiments of the present invention will not adversely interfere with or short circuit the magnetic paths which permit proper operation, and may, where desired, be designed to enhance the magnetic circuit.

A variety of designs have been contemplated for each of the embodiments illustrated herein, and will generally be configured to correspond to a particular manufacturer's gun geometries. The materials used for a particular design may be chosen not only based upon factors such as magnetic characteristic and weight, but may also factor in the particular design.

While the foregoing details what is felt to be the preferred and additional alternative embodiments of the invention, no material limitations to the scope of the claimed invention are intended. The variants that would be possible from a reading of the present disclosure are too many in number for individual listings herein, though they are understood to be included in the present invention. For exemplary purposes only, and not limited solely thereto, in the preferred embodiments the magnets are disclosed in pairs that are either attractive or repulsive as a pair. However, those skilled in the art of magnets and magnetic fields will recognize that for magnetically attractive pairs it is not necessary to use two magnets.

Instead, one material may be magnetic, while the second material may only be magnetically susceptible, such as soft iron or the like. Applicable to all embodiments, it is further possible to use and actively substitute a plurality of magnets rather than just two magnets, or magnets of different and selectable characteristics, in a particular embodiment. Furthermore, while some arrangements of pushing, pulling, ring or cylindrical alternatives have been illustrated herein, it will be understood that even where not illustrated, these various combinations and other magnet arrangements which are known from the present disclosure or the art are considered to be incorporated herein for each suitable embodiment. Therefore, features and design alternatives that would be obvious to one of ordinary skill in the art upon a reading of the present disclosure are considered to be incorporated also. The scope of the invention is set forth and particularly described in the claims herein below.

I claim:

1. In combination, a paint ball gun bolt, a bolt pin, and a magnetic coupling, said magnetic coupling engaging said bolt pin with said paint ball gun bolt in a first stable position holding said bolt pin stable relative to said paint ball gun bolt and having first and second unstable regions oppositely displaced from said first stable position, said magnetic coupling applying a force between said bolt pin and said paint ball gun bolt in said first and second unstable regions urging said bolt pin to move relative to said paint ball gun bolt.

2. The combination paint ball gun bolt, bolt pin, and magnetic coupling of claim 1, wherein said bolt pin further comprises at least one magnet, and said paint ball gun bolt further comprises at least one magnet.

3. The combination paint ball gun bolt, bolt pin, and magnetic coupling of claim 2, wherein said bolt pin further comprises at least one cylindrical magnet oriented parallel to a longitudinal axis of said bolt pin, and said paint ball gun bolt further comprises at least one ring magnet encircling said bolt pin.

4. The combination paint ball gun bolt, bolt pin, and magnetic coupling of claim 3, further comprising means to limit movement of said bolt pin relative to said paint ball gun bolt.

5. The combination paint ball gun bolt, bolt pin, and magnetic coupling of claim 3, wherein said bolt pin further comprises at least two cylindrical magnets oriented parallel to a longitudinal axis of said bolt pin.

6. The combination paint ball gun bolt, bolt pin, and magnetic coupling of claim 5, at least two cylindrical magnets are magnetized parallel to said bolt pin longitudinal axis and in opposite directions to each other.

7. In combination, a paint ball gun bolt and a bolt pin, said paint ball gun bolt having a ring magnet through which said bolt pin longitudinally passes, said bolt pin further comprising at least two cylindrical magnets which are polarized oppositely to each other along said bolt pin longitudinal axis.

8. The combination paint ball gun bolt and bolt pin of claim 7, further comprising a gap between said at least two cylindrical magnets.

9. The combination paint ball gun bolt and bolt pin of claim 8, wherein said ring magnet has a polarity adjacent to said gap between said at least two cylindrical magnets which is opposite to a polarity of each of said at least two cylindrical magnets at their most adjacent faces.

* * * * *